United States Patent [19]

Long

[11] Patent Number: 4,657,800

[45] Date of Patent: Apr. 14, 1987

[54] MURAL TYPE HANGING AND METHOD MAKING SAME

[76] Inventor: Jutta M. Long, 161 Ellsworth St., Bridgeport, Conn. 06605

[21] Appl. No.: 608,866

[22] Filed: Aug. 20, 1985

[51] Int. Cl.[4] ..... A47G 33/06; B44F 3/00

[52] U.S. Cl. ..... 428/102; 156/93; 362/123; 362/806; 428/18; 428/904.4; 434/95

[58] Field of Search ..... 428/906.6, 13, 18, 102, 428/156, 542.8, 904.4; 28/144; 40/160; 362/123, 806; 434/95; 156/93

[56] References Cited

U.S. PATENT DOCUMENTS

| | | | |
|---|---|---|---|
| 1,791,533 | 2/1931 | Parmele | 428/18 X |
| 2,306,081 | 12/1942 | Pollock | 428/18 X |
| 2,798,328 | 7/1957 | Fasino | 428/39 X |
| 3,269,032 | 8/1966 | Sumner | 428/187 X |
| 3,463,918 | 8/1969 | Franc | 428/7 X |
| 3,800,436 | 4/1974 | Matzek | 434/95 |
| 3,857,748 | 12/1974 | Thomann | 428/8 |
| 3,970,338 | 7/1976 | Crowe | 428/187 X |
| 4,202,569 | 5/1980 | Thuringer | 428/906.6 X |
| 4,480,293 | 10/1984 | Wells | 362/806 X |
| 4,537,806 | 8/1985 | Sherrard | 362/806 X |

*Primary Examiner*—Henry F. Epstein
*Attorney, Agent, or Firm*—Arthur T. Fattibene

[57] ABSTRACT

A method and article of manufacture directed to a mural like device which is formed on a blank or sheet of flexible fabric type material by the forming in the surface thereof a pattern to define predetermined form. Strands of yarn material formed in closely spaced spiral loops are secured to the blank or sheet material along the pattern formed thereon as e.g. by sewing. The loops so fixed are severed along the free end thereof to impart a three dimensional effect to the pattern. Illuminating lights are disposed along the pattern for added visual effects and decorative or ornamental devices may also be interposed between and/or to compliment said lights for additional visual effects.

5 Claims, 7 Drawing Figures

FIG. 1
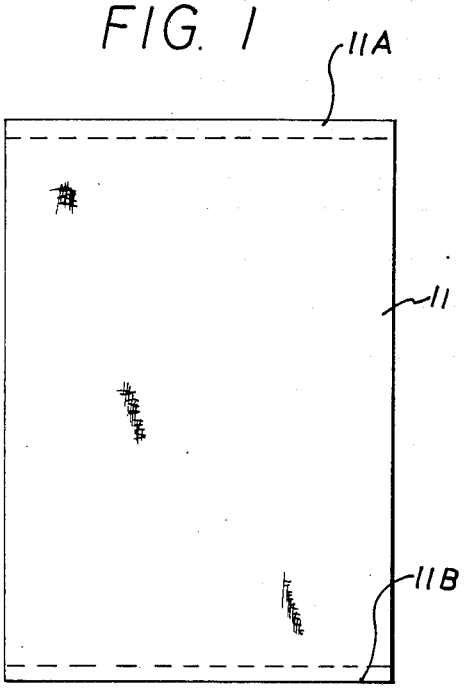
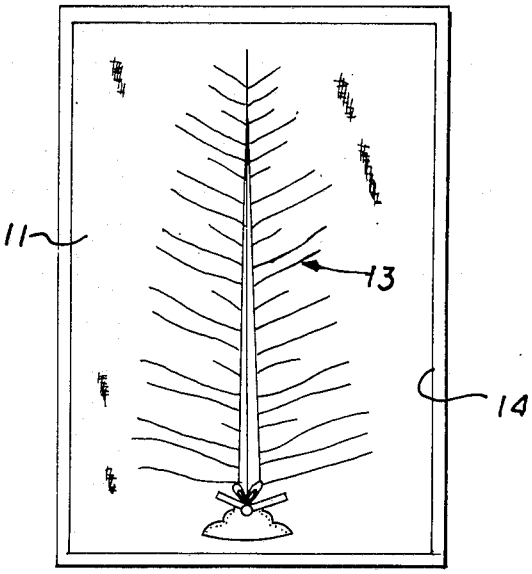
FIG 4
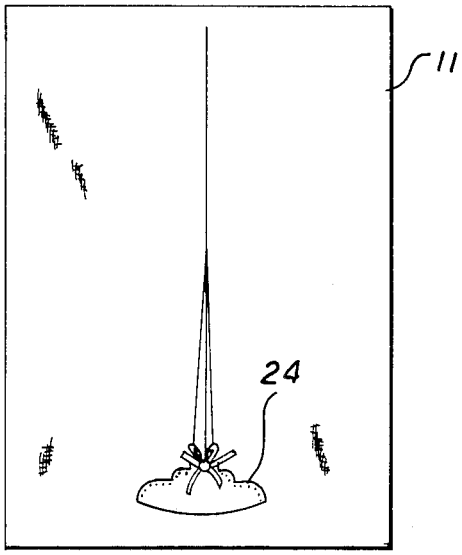
FIG. 2
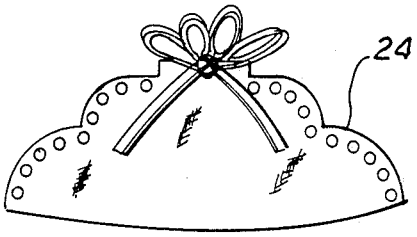
FIG. 3
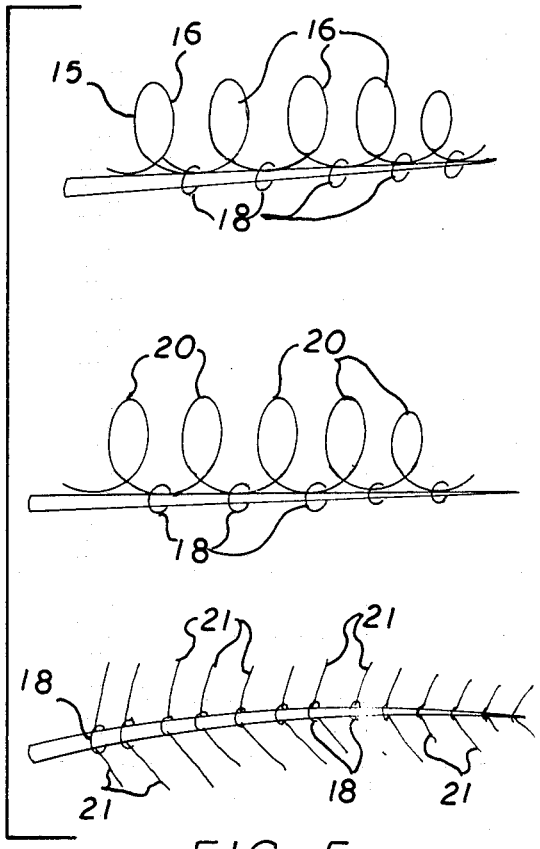
FIG. 5

MURAL TYPE HANGING AND METHOD MAKING SAME

FIELD OF INVENTION

This invention relates to an article of manufacture and method of making the same, and more specifically to a needlecraft ornamental hanging or mural.

PRIOR ART

Various types of needlecraft ornamental articles are known as evidenced by the following known patents: U.S. Pat. Nos. 1,791,533; 2,306,081; 2,798,328, 3,269,032; 3,463,918; 3,857,748 and 3,970,338.

OBJECTS

An object of this invention is to provide an article of manufacture and a method of forming the same that is relatively simple, can be easily fabricated and which results in a new and different type of ornamental mural type hanging.

Another object is to provide a needlecraft type article which is specifically directed to a Christmas tree.

SUMMARY OF THE INVENTION

The present invention is directed to a method and product comprised of a mural adapted to be hung on a vertical surface, and which will give the illusion of a three dimensional scene. This is attained by forming a background of the mural from a sheet or blank flexible material or fabric on which a predetermined pattern is formed. Strands of appropriate colored yarn are then superimposed over the outline of the pattern and secured thereto by suitable means such as e.g. sewing. The yarn may be coiled in a series of closely spaced spiral loops prior to sewing or securing to the pattern. The free ends of the secured spiral loops are then severed to impart a three dimensional effect to the pattern. For added visual appeal, illuminations in the form of light bulbs electrically connected and located at selected points in the pattern and/or other decorative devices such as beads, ornaments and the like may be incorporated into the pattern depending upon the particular theme of the pattern. A marginal portion of the blank is hemmed to provide a passage for a rod for supporting the mural on a vertical support.

FEATURES

A feature of this invention resides in the provision of a needlecraft mural wherein the ornamental design is formulated by a series of looped yarn layed onto a backing sheet in accordance with a predetermined design or pattern.

Another feature resides in the provision wherein the looped yarn is severed at its free end to impart a three dimensional effect to the pattern.

Another feature resides in the provision of illumination to the mural for enhancing the overall appeal.

BRIEF DESCRIPTION OF THE DRAWINGS

Other features and advantages will become more readily apparent when considered in view of the drawing and description in which:

FIG. 1 is a plan view of a blank or sheet of flexible material partially formed in accordance with the present invention.

FIG. 2 is a plan view of a blank shown in FIG. 1 having a portion of a predetermined pattern formed thereon.

FIG. 3 is a detailed view of a fragmentary portion of the pattern formed on said blank.

FIG. 4 is a plan view of a predetermined pattern outlined on the blank of FIG. 1.

FIG. 5 illustrates the steps in which the yarn applied to the pattern of FIG. 4 is looped, secured and severed to give the desired effect to the finishing pattern.

DETAIL DESCRIPTION

Figure 7:
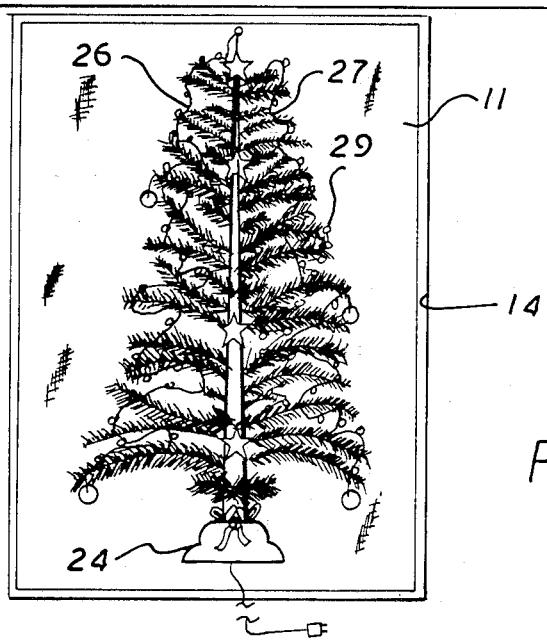
FIG. 7 is a plan view of a completed article of manufacture embodying the present invention.

Referring to the drawings, there is shown in FIG. 7, an article of manufacture embodying the present invention. The article of manufacture is a sheet of flexible material 11, upon which there is formed, in accordance with this invention, a three dimensional image. In the illustrated embodiment, the image or indicia is shown in the form of a Christmas tree fully decorated.

Referring to FIG. 1, the article of manufacture is formed of a suitable blank of sheet material, e.g. fabric 11 which may be hemmed at top and/or bottom as shown at 11A and 11B. The upper hem 11A is adapted to receive a rod (not shown) by which the finished article 10 may be hung on a suitable surface.

As shown in FIGS. 2 and 4, an outline 13 of a predetermined image or form is drawn on the fabric 11 to define a pattern. The illustrated pattern is an outline of the Christmas tree design to be made.

If desired, the peripherial portions of the blank or fabric may be provided with a border of crochet yarn 14 to give the illusion of a frame.

In accordance with this invention, yarn is laid onto the predetermined pattern or outline 13 by looping the yarn 15 to form a series of spiral loops 16 as shown in FIG. 5. The looped yarn as shown in FIG. 5 is then secured to the fabric background 11 by sewing with a needle and thread through the base end of the looped yarn as indicated at 18 so that the looped yarn is firmly secured to the background fabric. It will be understood that the looped yarn follows the lined outline of the image formed on the backing fabric 11.

In order that the looped yarn can simulate the pine needles of a Christmas tree, various colors of green yarn may be used. Also, the free end of the respective loops are cut, e.g. at 20, whereby the severed ends are then folded to either side of the drawn lines simulating the tree branches. The laying over of the severed yarn thus gives the effect of actual pine needles 21. See FIG. 5, lower illustration.

The trunk portion of the tree design is given a natural effect by utilizing cut felt of appropriate coloring and a simulated tree stand 24 can also be formed of suitable felt cut to shape as shown, and sewn to the background fabric 11.

Figure 6:
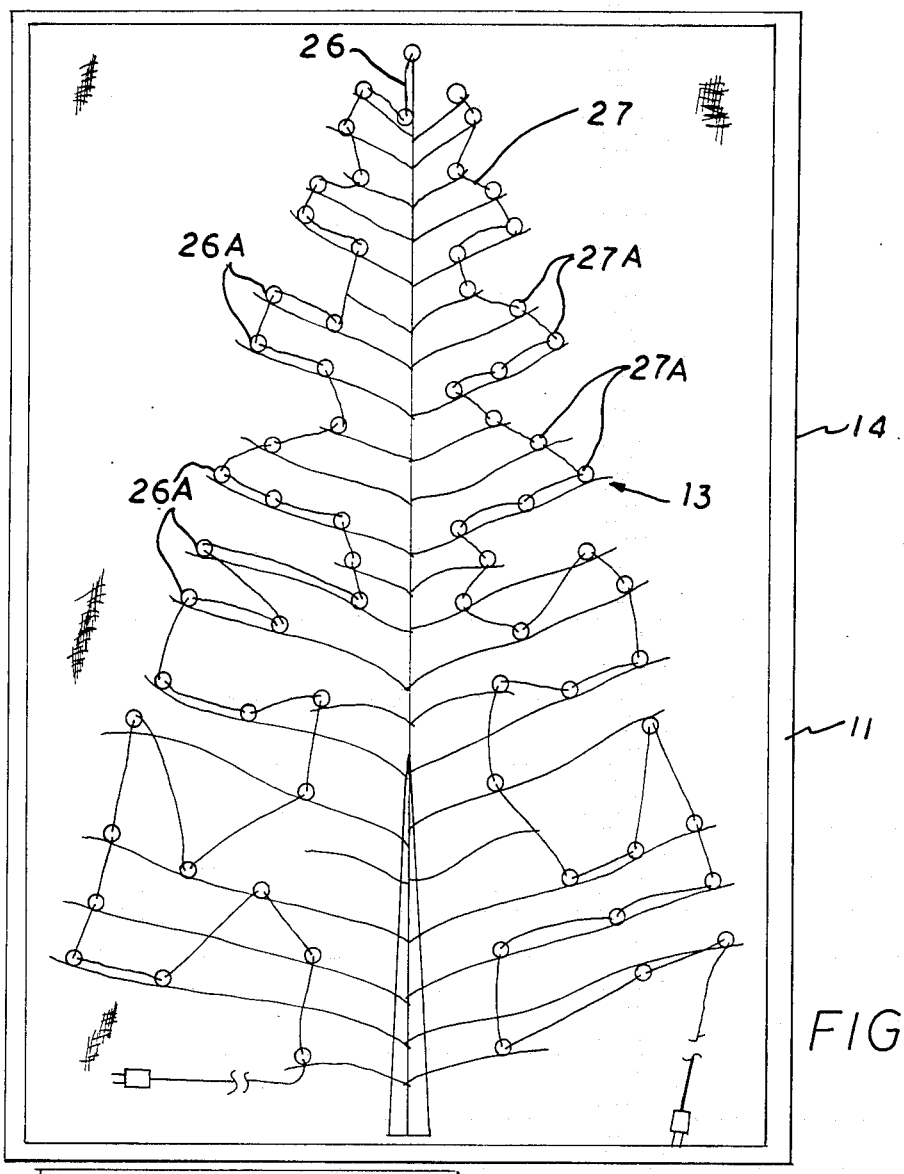
FIG. 6 illustrates the application of the illuminating means to the predetermined pattern.

For added appeal, illumination can be added. As shown in FIG. 6, a string of lights 26 including a plurality of bulbs 26A connected in an electrical circuit are selectively positioned as shown. One string of lights can be disposed to one side of the image and a second string of lights 27 including a plurality of bulbs 27A can be located on the opposite side.

The illustrated Christmas tree design can be further decorated by applying various color strings of beads and/or other decorative Christmas like ornaments. The decorative beads 29 may be strung and secured by sewing to the background material 11. Fine decorations, such as crochet snowflakes, with appropriate glitter, can be included to complete the mural.

While the invention has been described as used to form a Christmas tree pattern or mural, it will be understood that various modifications and variations may be formed without departing from the spirit or scope of the invention.

What is claimed is:

1. A mural type hanging comprising:

a sheet of flexible fabric type material, means defining a hem extending along a peripheral portion of said sheet, means defining a predetermined pattern formed on a surface portion of said sheet;

strands of fibrous yarn looped to define an elongated series of spirals disposed coincidental to the form of said pattern so as to conform generally to the shape of said pattern, means for fixedly securing said strands of looped yarn to said sheet at the base end of the respective loops, said last mentioned means including a sewn seam for securing said looped strands to said sheet, whereby said loops are cut, the respective free ends being disposed to either side of said seam, to impart a 3-dimensional effect to said pattern;

illuminating means located at pre-selected points along said pattern, and decorative means disposed along said pattern in a predetermined manner.

2. A method for forming a mural type hanging comprising the steps of selecting a sheet of fabric material of a predetermined size and shape, forming on the surface of said sheet of material a pattern to define a predetermined form, looping an elongated strand of yarn material with a plurality of closely spaced spiral loops, laying the closely spaced spiral loops along the pattern formed on said sheet, securing said closely spaced loops to said sheet along said pattern, whereby one end of said loops are secured to said sheet, and cutting said loops at the free end thereof whereby the severed ends of said loops are disposed to opposite sides of the secured end thereof.

3. A method as defined in claim 2 and including the step of placing illuminating means at predetermined points along said pattern.

4. A method as defined in claim 2 wherein said pattern is formed in the shape of a Christmas tree, and said severed ends of said looped yarns define the needle effect of the Christmas tree.

5. A method as defined in claim 4 including the step of placing a string of illuminating means including a plurality of electrically connected light bulbs on said pattern;

attaching said light bulbs of said string of illuminating means to said pattern, and placing decorative devices at selected positions on said tree pattern.

* * * * *